US005927370A

United States Patent [19]

Judkins

[11] Patent Number: 5,927,370

[45] Date of Patent: Jul. 27, 1999

[54] RELEASE BRAKE SHADE OPERATOR

[76] Inventor: Ren Judkins, 46 Newgate Rd., Pittsburgh, Pa. 15202

[21] Appl. No.: 08/972,275

[22] Filed: Nov. 18, 1997

[51] Int. Cl.[6] ..... E06B 9/56

[52] U.S. Cl. ..... 160/291; 160/84.04; 160/298; 160/321

[58] Field of Search ..... 160/170 R, 171 R, 160/84.04, 84.05, 193, 291, 298, 321; 192/223.4, 223

[56] References Cited

U.S. PATENT DOCUMENTS

| | | | |
|---|---|---|---|
| 203,414 | 5/1878 | Buckley et al. . | |
| 1,841,384 | 1/1932 | Schmelz | 160/298 |
| 2,140,049 | 12/1938 | Grauel | 156/10 |
| 3,292,685 | 12/1966 | Clark | 160/26 |
| 4,372,432 | 2/1983 | Waine et al. | 192/8 C |
| 4,424,851 | 1/1984 | Kohayakawa | 160/298 |
| 4,427,100 | 1/1984 | Rude et al. | 192/43 |
| 4,433,765 | 2/1984 | Rude et al. | 192/41 S |
| 4,651,854 | 3/1987 | Harada | 192/8 C |
| 4,779,662 | 10/1988 | Wilk | 160/321 |
| 4,869,308 | 9/1989 | Chang | 160/176.1 |
| 4,869,357 | 9/1989 | Batchelder | 192/41 S |
| 5,167,269 | 12/1992 | Abo | 160/305 |
| 5,314,053 | 5/1994 | Nishimura | 192/41 S |
| 5,361,882 | 11/1994 | Nijs | 160/321 |
| 5,375,643 | 12/1994 | Rude | 160/321 |
| 5,482,105 | 1/1996 | Rude | 160/307 |
| 5,507,374 | 4/1996 | Rude | 192/8 C |
| 5,542,464 | 8/1996 | Shiina | 160/296 |
| 5,628,356 | 5/1997 | Marocco | 160/170 R |
| 5,647,421 | 7/1997 | Hoffmann et al. | 160/291 |
| 5,791,393 | 8/1998 | Judkins | 160/321 |

*Primary Examiner*—Blair M. Johnson
*Attorney, Agent, or Firm*—Buchanan Ingersoll, P.C.

[57] ABSTRACT

A release brake shade operator for a window covering has a stationary member, a movable member movable relative to the stationary member, and a hub which is movable relative to the stationary member and the movable when not restrained. Preferably the hub is a tube or solid cylinder. A spring having a selected diameter is fitted between the stationary member and the movable member and surrounds a portion of the hub. A first tang at one end of the spring is attached to the stationary member and a second tang at an opposite end of the spring is attached to the movable member so that one tang can be moved relative to the other tang to increase the diameter of the spring. The spring is sized and positioned so that the spring will press against the outside surface of the hub when in a relaxed condition restraining the hub and attached to the roller shade or lift cords. The tangs of the spring are moved relative to one another by rotating the movable member to increase the diameter of the spring which releases the hub and allows it to rotate freely. Preferably the hub has a spool attached to one end about which a cord loop is wound which operates the movable member and the hub. In a present preferred embodiment the an offset gear arrangement which preferably has a slip clutch is interposed between the hub and the roller.

44 Claims, 10 Drawing Sheets

FIG. 7
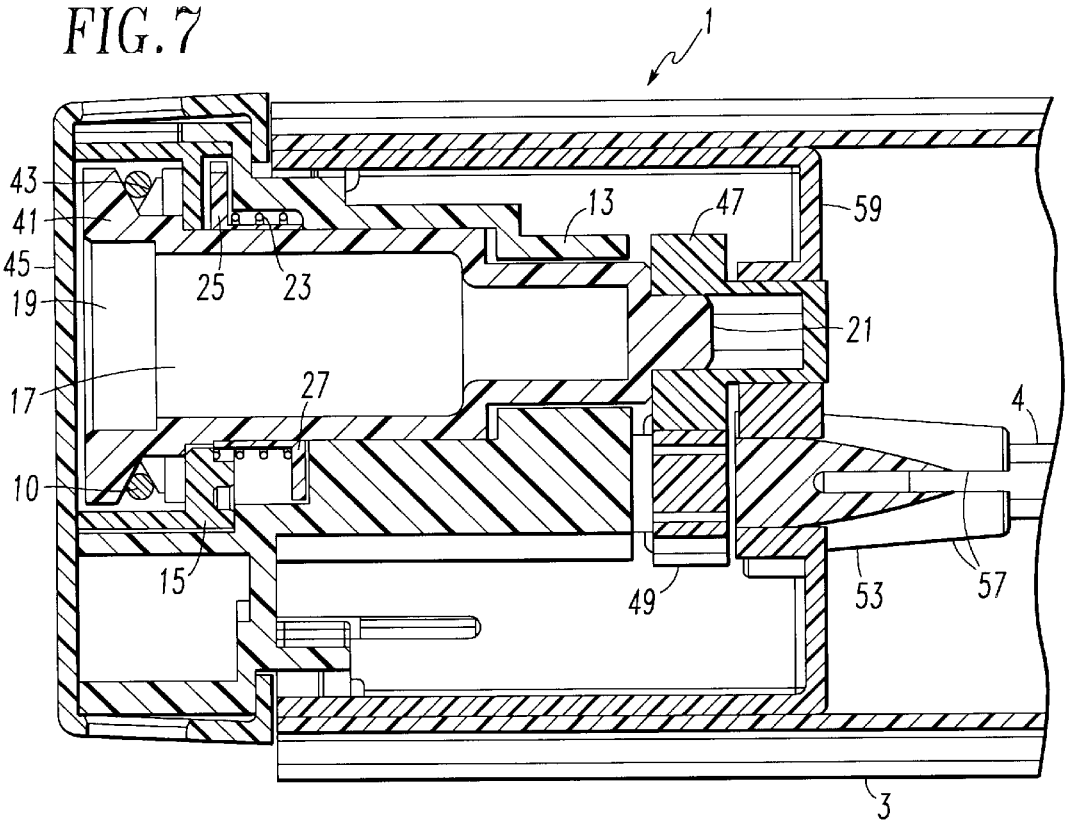
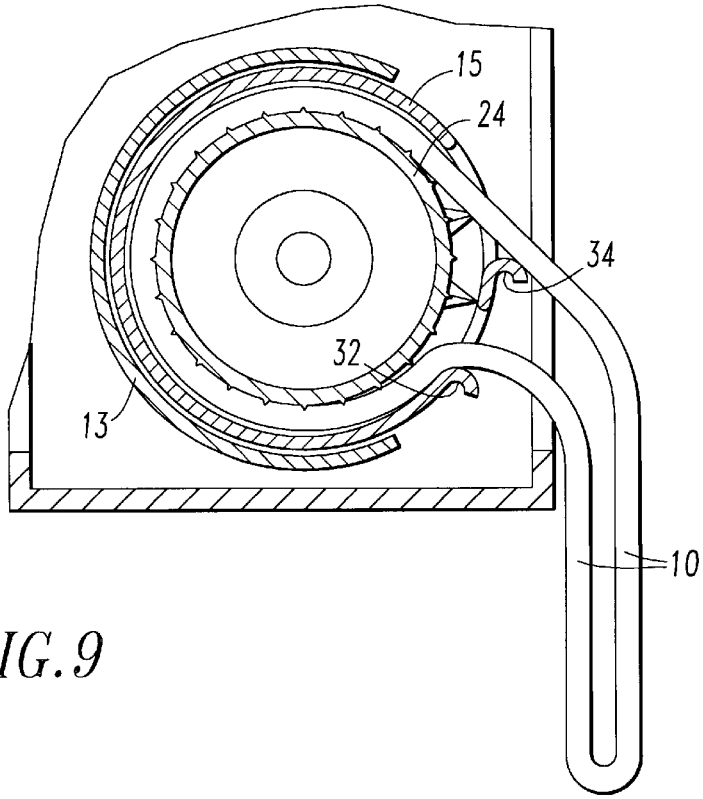
FIG. 9

RELEASE BRAKE SHADE OPERATOR

FIELD OF THE INVENTION

The present invention relates to a device for operating and positioning a window covering, particularly a covering that is raised and lowered like a roller shade, a pleated shade, or a venetian blind.

DESCRIPTION OF THE PRIOR ART

In a roller shade window covering material is rolled and unrolled around a tubular core hung on brackets. Conventionally, a spring is provided within the core to raise and counterbalance the lowering of the shade. In a pleated or cellular shade, lift cords are rolled or unrolled about take up spools carried on a central shaft. Conventionally, the shaft, take up spools, and the shade operating mechanism is enclosed within a headrail which is hung on brackets. Additionally, a bottom rail is usually provided for added weight at the bottom of the shade to assist in lowering the window covering when the lift cords are unrolled.

The prior art most commonly used for controlling the vertical position of a roller window shade is the ratchet and pawl mechanism. Examples of this mechanism are shown in U.S. Pat. Nos. 203,414 and 2,140,049. The ratchet and pawl mechanism has been in use for many years, but it is notoriously unpopular among users. Criticisms include the necessity of handling the shade material in order to operate the shade, and unreliable operation. Ratchet and pawl mechanisms are often difficult to engage and can only be set at heights corresponding to the tooth spacing of the ratchet. Many times the ratchet and pawl mechanism wears out before other components of the shade.

Another prior art device for controlling window shades is the friction brake. Examples of such brakes are disclosed in U.S. Pat. Nos. 5,184,660 and 5,482,105. These devices have a coiled spring between a central core and a sleeve. These devices apply a fixed torque to resist rotation of the shade roller no matter which direction the roller is turned. These devices suffer from the disadvantage that a substantial force is needed to raise the shade.

The prior art also contains examples of clutch mechanisms that are adapted for the operation of roller shades. Among these are U.S. Pat. Nos. 4,372,432 and 5,361,822. Prior art clutch mechanisms overcome some of the disadvantages of ratchet and pawl devices, but they have some disadvantages of their own. The clutch based devices are operated by a cord loop that hangs from one end of the shade roller. The cord loop eliminates the need for handling of the shade material or a protective shield attached thereto, and the clutch mechanism allows the height of the shade to be precisely set. It also permits the shade to be operated from one end rather than from the center which can be difficult to reach if the window is behind a piece of furniture. Also, clutch devices tend to be somewhat more expensive than the ratchet and pawl devices, and they require some amount of lost motion to insure proper operation. This lost motion is apparent when beginning to raise the shade. When the cord is first pulled, some motion is required before the shade begins to move. Also, the lost motion can contribute to an oscillating, or surging motion while the shade is lowered.

Clutches and friction brakes have also been used in pleated shades and venetian blinds where the lift cords are wound around a take-up roll located within the headrail. The takeup roll is driven by a loop cord or motor. The loop cord is the subject of child safety concerns and the motorized system is significantly more expensive.

Consequently, there is a need for a reliable shade operator that allows an operator to easily raise and lower shades to any desired position. Preferably, the shade operator should be easy and inexpensive to manufacture and not have any protruding components which could be broken off.

SUMMARY OF THE INVENTION

I provide a release brake shade operator for a window covering of the type having a roller about which either a window covering material or lift cords are wound. There is a stationary member, a movable member, in the shape of a drum, which is movable relative to the stationary member, and a hub which is movable relative to the movable member and the stationary member when not restrained. Preferably the movable member is a tube and the hub is a tube or solid cylinder sized to rotate relative to the movable member and the stationary member. A spring having a selected diameter is fitted laterally between the stationary member and the movable member and lightly rubs on the exterior surface of the cylindrical hub. A first tang at one end of the spring is attached to the stationary member. The second tang at an opposite end of the spring is attached to the movable member so that one tang can be moved relative to the other tang to change the diameter of the spring. The spring is sized and positioned so that the spring will encircle and lightly press against the outside surface of the hub when in a relaxed condition. When the hub is turned in the direction to lower the shade the spring quickly changes diameter to bind the hub, but when the hub turns in the opposite direction the spring changes diameter in the opposite direction and releases the hub. When the tangs of the spring are moved relative to one another to increase the diameter of the spring, the spring does not restrain movement of the hub. This allows a shaft or roller attached to the hub to turn freely. Then the lift cords on the shaft or the shade wound around a roller may unwind or be wound by the operator. A counter balance spring is attached to the shaft or roller.

In a present preferred embodiment that has lift cords there is a spool attached to the hub at one end and a square or hex shaped projection at an opposite end. The hub and movable member fit within a recess in the stationary member. Additionally, the spool fits within a cylindrical recess in the face of the movable member. The hub drives the shaft via the hex shaped projection. Preferably the hub is offset from the central shaft towards the front of the headrail using an arrangement of two offset gears. Also, a slip clutch is preferably interposed between the central shaft and the offset gear which drives it.

Other details, objects and advantages of my invention will become apparent from the following description and the accompanying drawings of certain presently preferred embodiments thereof.

BRIEF DESCRIPTION OF THE DRAWINGS

In the accompanying drawing figures, certain preferred embodiments of the invention are illustrate in which:

FIG. 7 is a top view partially in section of the present preferred release brake shade operator.

FIG. 9 is a sectional view taken along the line IX—IX in FIG. 4.

DETAILED DESCRIPTION OF THE PREFERRED EMBODIMENTS

Figure 1:
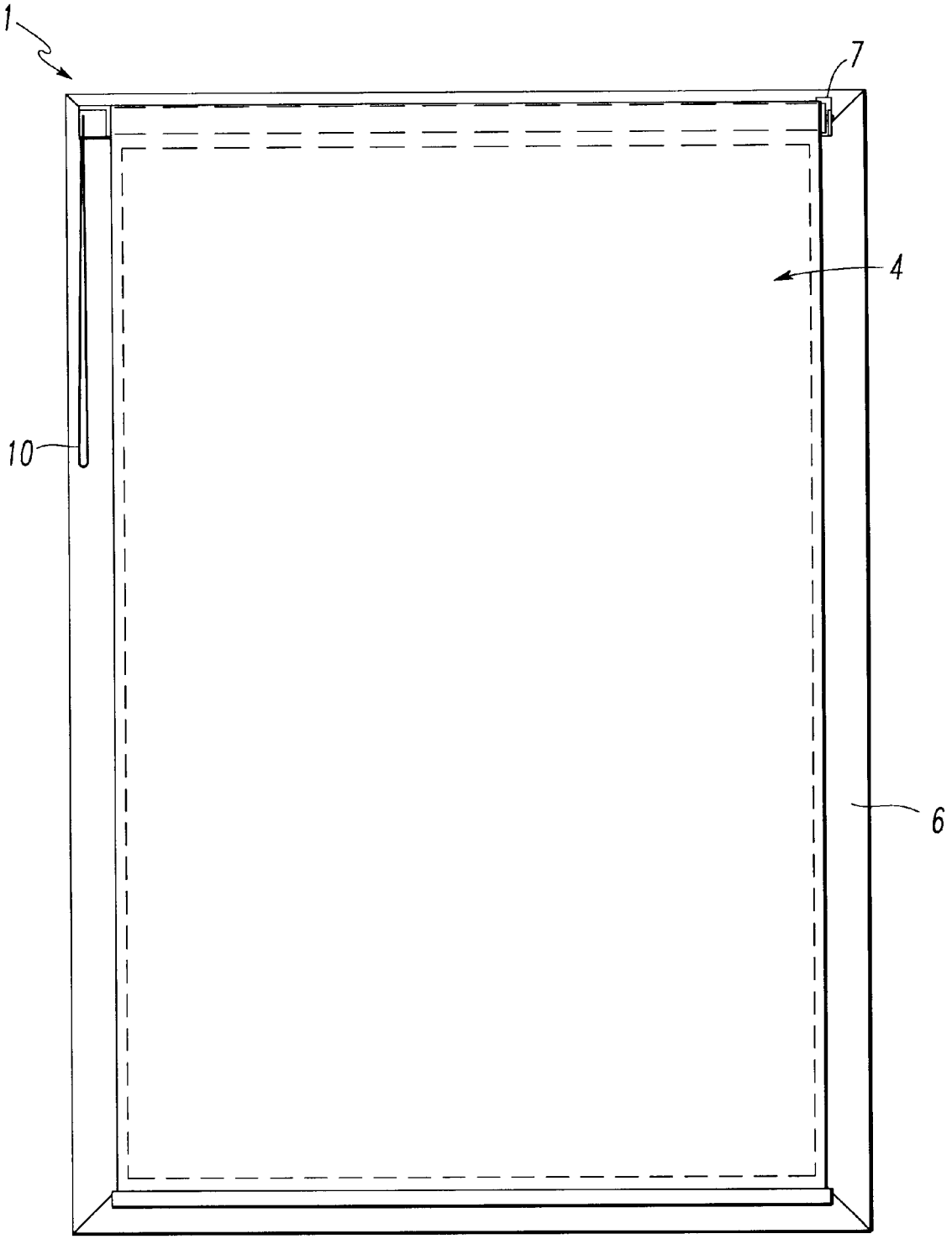
FIG. 1 is a front view of a roller shade containing a present preferred release brake shade operator in a fully lowered position.
Figure 2:
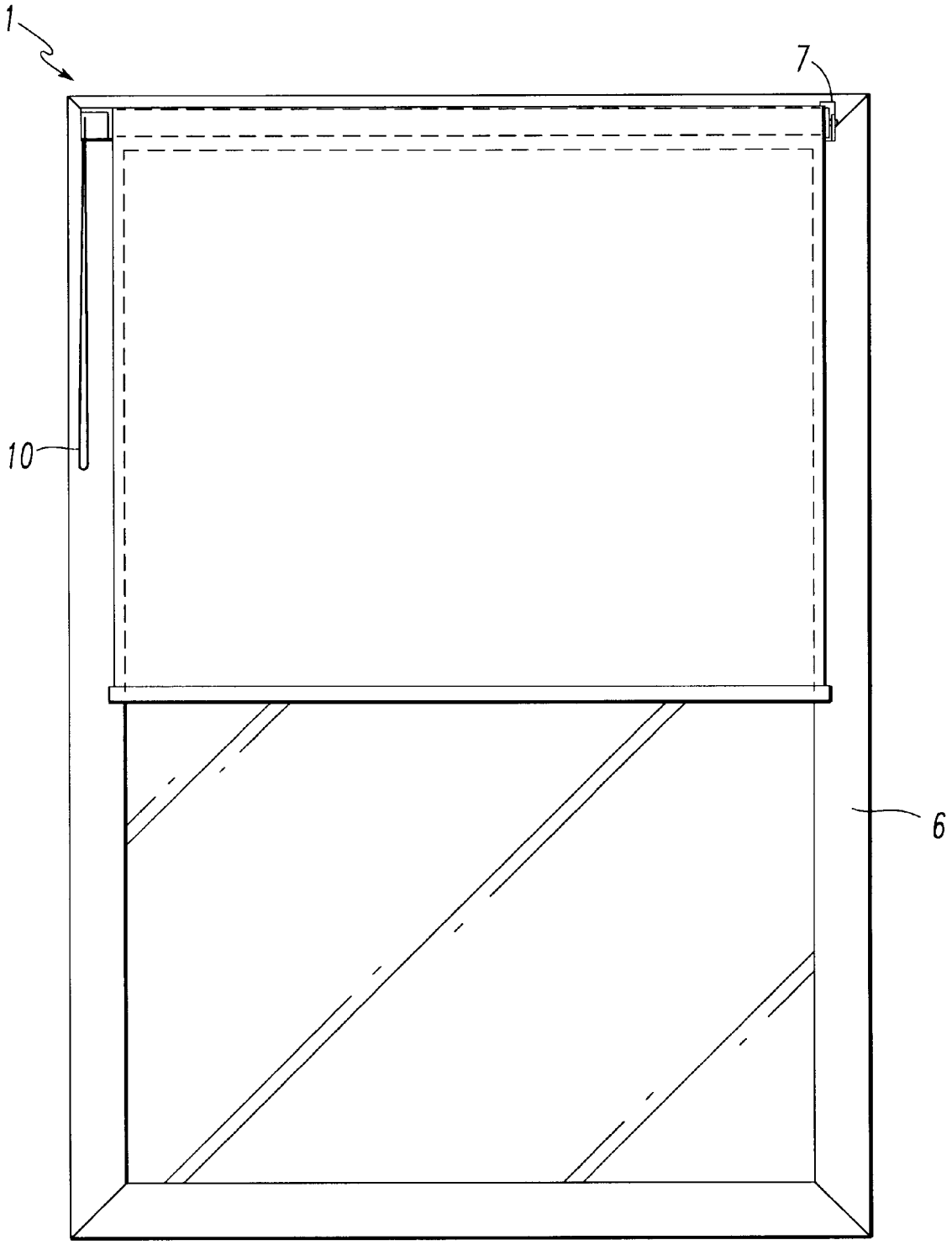
FIG. 2 is a front view similar to FIG. 1 showing the roller shade in a partially lowered position.
Figure 3:
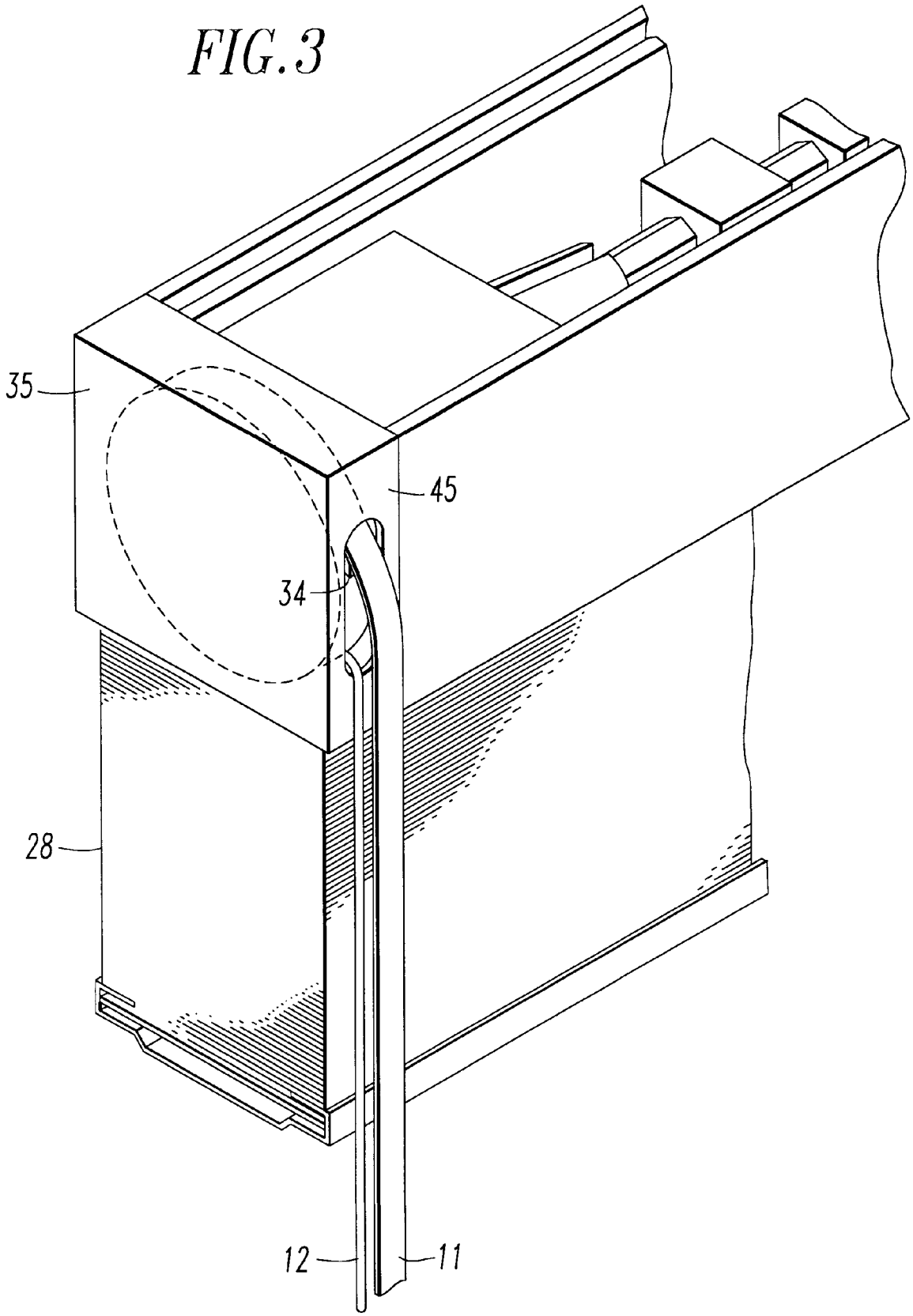
FIG. 3 is a perspective view of an end portion of a pleated shade in a fully raised position which shade contains a present preferred shade operator that utilizes a release cord.
Figure 4:
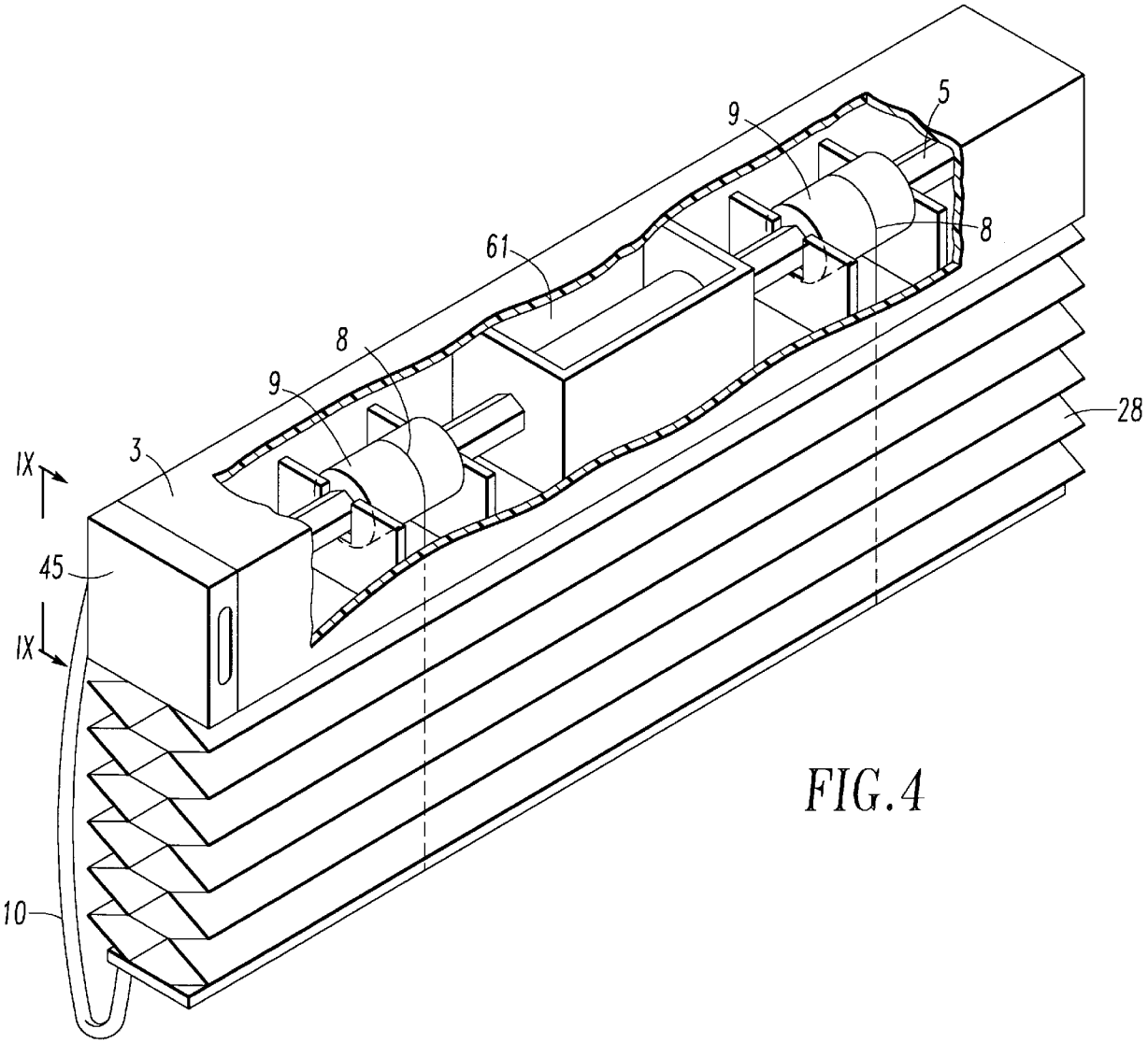
FIG. 4 is a perspective view of the end portion of the pleated shade of FIG. 3 in a lowered position and with the headrail partially cut away to show the central shaft and take up spools for the lift cords.
Figure 5:
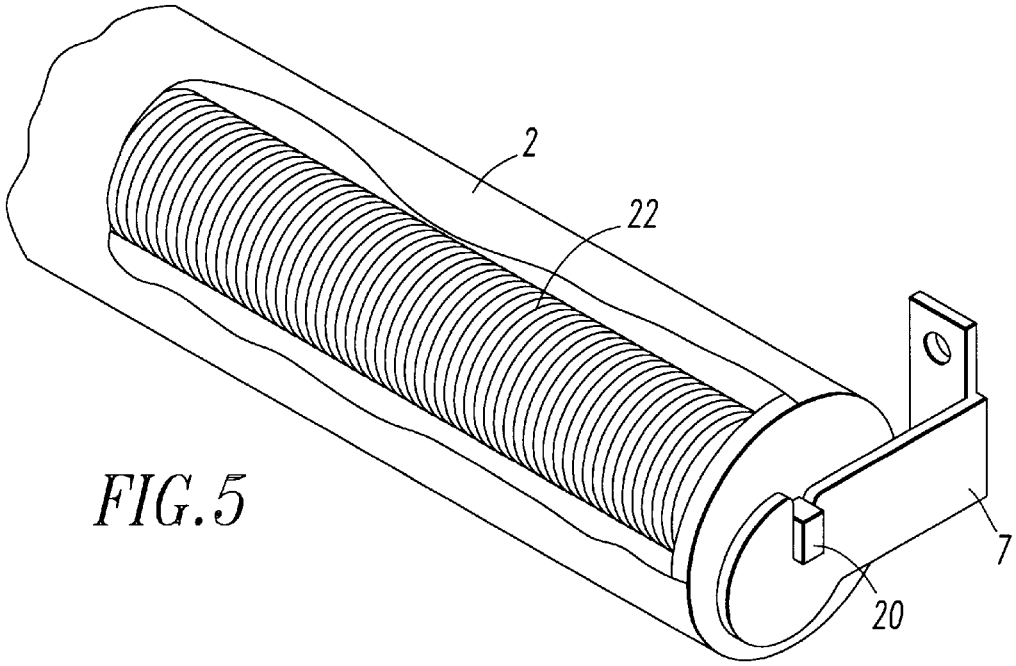
FIG. 5 is an end view partially cut away of a roller shade showing a counterbalance spring within the shade.

I provide a shade operator that may be used in conjunction with a roller shade 4 such as shown in FIGS. 1 and 2 or a pleated or cellular shade 28 such as shown in FIGS. 3 and 4. When used in a roller shade, the shade the shade operator 1 is provided at one end of the roller shade. This shade is mounted on window frame 6 by bracket 7. As can be seen most clearly in FIG. 5 there is a roller axle 20 which fits within a slot in the bracket 7. This connection keeps the roller axle 20 stationary while the roller 2 may rotate around stationary roller axle 20. An optional counteracting spring 22 is provided within the roller at the end opposite my shade operator. One end of the counteracting spring is attached to roller 2 while the opposite end is attached to a stationary axle 20. The spring is in a relaxed position when the shade is somewhere in between the fully raised and fully lowered position. This may be higher or lower than shown in FIG. 2. One way to accomplish this is to disengage the axle 20 from the bracket when the window covering is at the desired position. The spring unwinds to a relaxed state and the axle 20 is replaced onto the mounting bracket after the spring has unwound. The spring 22 winds when the shade is moved up or down from the neutral position. The spring is not intended to lift the shade, but simply to slow the descent speed and partially counter-balance the load. When the shade is moved up from the neutral position, the spring 22 winds and encourages the shade to descend. This is helpful when the shade is completely raised and wrapped on the roller and the edge of the shade is rubbing against the bracket or spool. In this case, the weight of the shade is insufficient to overcome the friction in the system and lower the shade. The tension in spring 22 can overcome the friction and ensure that the shade descends.

I prefer to provide a looped cord 10 shown in FIG. 4 to operate those blinds having lift cords. For those shades having a roller, I prefer to use tape or cord 11 wound around the spool as shown in FIG. 3. As the shade is lowered the tape 11 is rolled onto the spool. Conversely, when the shade is raised the tape 11 is unrolled from the spool. A release cord 12 is provided to release the shade operator.

In the pleated or cellular shade 28 shown in FIGS. 3 and 4, the headrail is mounted to the window frame in a conventional manner. The lift cords 8 of the pleated or cellular shade are wound about take-up spools 9 within headrail 3 as shown in FIG. 4.

Figure 8:
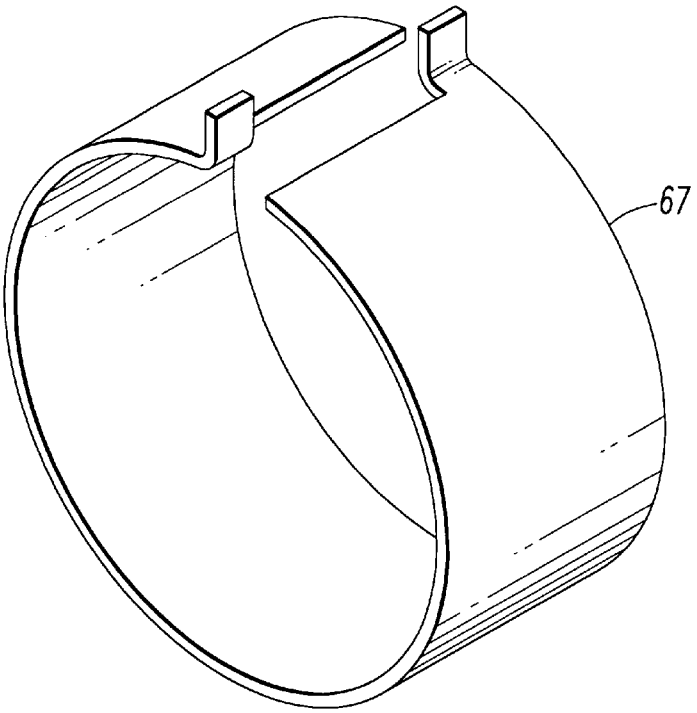
FIG. 8 is a perspective view of a present preferred alternative spring that can be used in the present preferred release brake shade operator.
Figure 6:
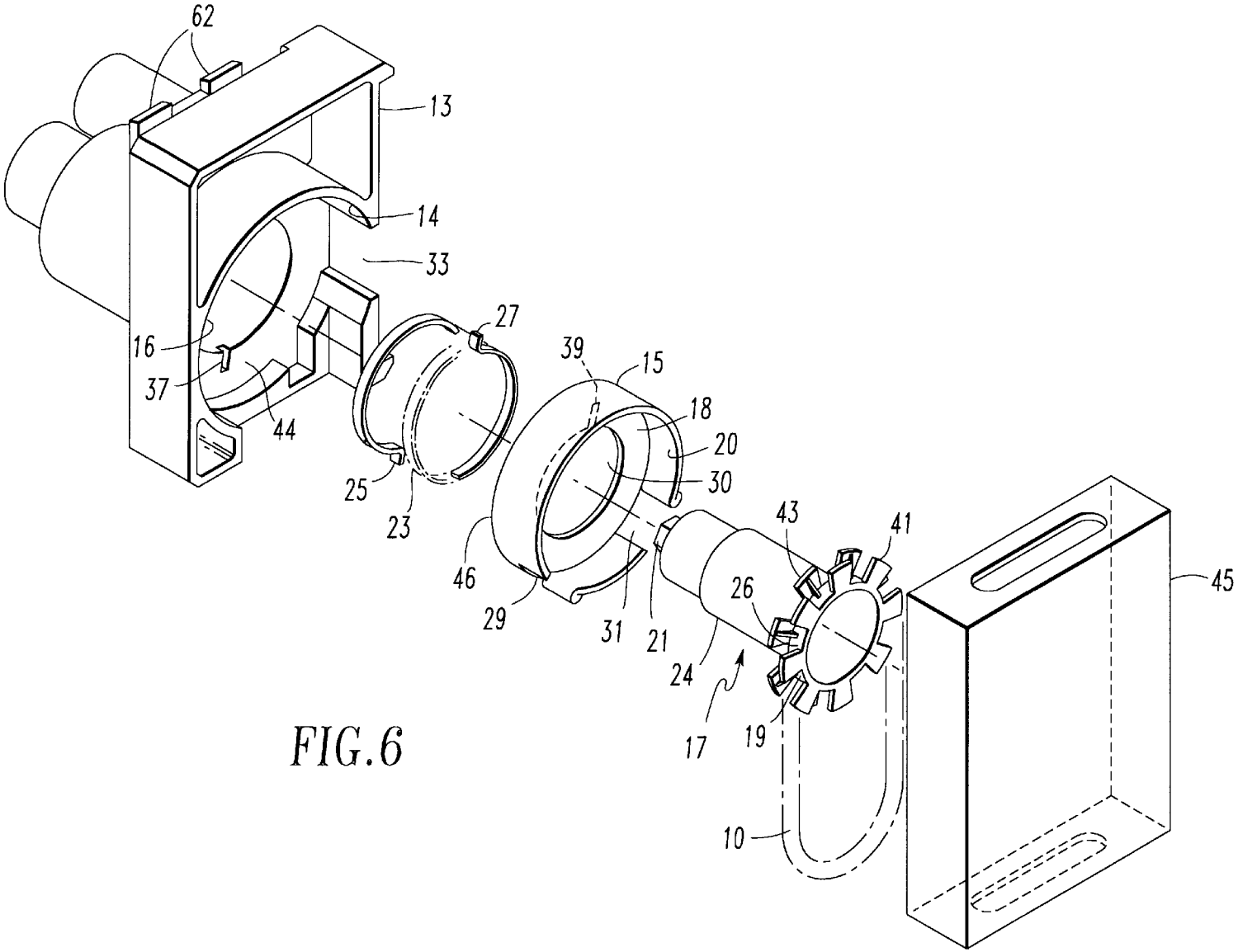
FIG. 6 is an exploded view of the present preferred release brake shade operator.

Referring now to FIGS. 6 and 7, the present preferred embodiment of my release shade operator 1 has a fixed housing 13 with a cylindrical recess 14 in the front face and a stepped cylindrical bore 16 in the recessed portion 18 which extends entirely through the fixed housing 13. A movable member 15, in the shape of a cylindrical drum, is rotatably disposed in the cylindrical recess 14 and a hub 17 having a cylindrical body 24 which is rotatably disposed through a cylindrical bore 30 in the movable member 15 and also extends through the cylindrical bore 16 in the fixed housing 13. The movable member 15 also has a cylindrical recessed face 18 sized to rotatably enclose a spool 19 which is rigidly attached to one end of the cylindrical body 24 of the hub 17. The hub 17 also has a square or hex shaped projection 21 extending longitudinally from the end of the hub 17 opposite the spool 19. The projection 21 extends through the bore 16 in the fixed housing 13. A spring 23 is provided around the cylindrical body 24 of the hub 17 and is positioned between a step in the fixed housing 13 and the movable member 15. The spring 23 is preferably a coil spring, but a spring 67 formed from a flat coil, as shown in FIG. 8, could also be satisfactorily employed. The bore 16 in the fixed housing 13 and the rear face of the movable member 15 each have a notch 37, 39 provided therein for retaining one of two tangs 25, 27 provided at opposite ends of the spring 23. The opposite faces of the tangs 25, 27 which press against the adjacent side, or bearing surface, of the slots when a face acts on the spring or movable member. The inside of the diameter of the spring 23, or 67, is sized to lightly grip the outside surface of the cylindrical body 24 of the hub 17 in order to sense the direction of rotation and allow rotation in one direction and prevent rotation in the other direction. The movable member 15 is rotated to cause the tang 27 retained in the notch 39 in the movable member 15 to be moved with respect to the opposite tang 25, which is retained in the fixed housing 13. The spring 23 is positioned such that counter clockwise rotation of the movable member 15 causes the coils of the spring 23 to open up which allows the hub 15 to rotate freely inside the coil. Thus, rotation of the movable member 15 counter clockwise releases the hub allowing the shade operator or lift cord shaft to freely rotate. In that condition the window blind is free to fall to a fully lowered position or a kickoff and counterbalance spring attached to the roller will unwind turning the shaft or roller.

The cord 10 is preferably a looped cord and is positioned around the spool 19 in a channel 26. However, a separate release brake cord 11 combined with a spooled ribbon could be satisfactorily employed in place of the looped cord 10 as shown in FIG. 3. The channel 26 is defined by a number of opposed, offset tabs 41 which project radially from the spool 19. Additionally, I prefer to provide triangular ribs 43 extending from each tab 41 into the channel 26. When the cord 10 is disposed in the channel 26 the ribs 43 help to grip the cord 10 to prevent slipping and provide positive shade movement. The diameter of the cord 10 is sized to fit snugly in the channel 26 in the spool 19 and is enclosed therein by the sidewalls 20 of the inside portion 18 of the movable member 15. Both ends of the cord loop 10 extend through the front of the headrail 3 through two openings 29, 31 provided in the sidewalls 20 of the recessed portion 18 of movable member 15. Preferably, one wide opening 33 is provided in the fixed housing 13 adjacent to the two openings 29, 31 in the movable member 15 which is large enough to permit both ends of the cord loop 10 to pass therethrough. Finally, a similar single opening in the cover permits the loop to descend to the person operating the shade.

Figure 11:
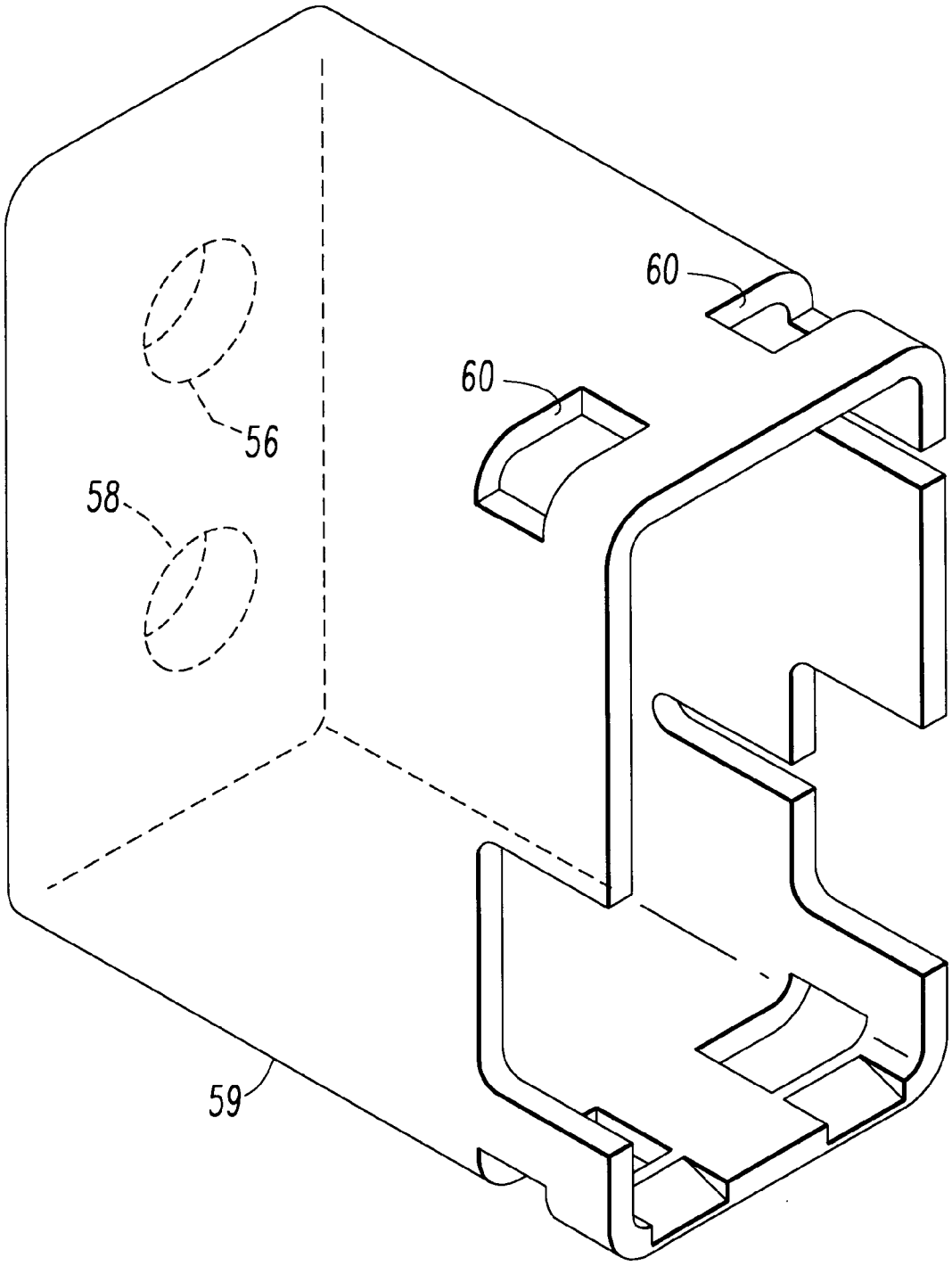
FIG. 11 is a perspective view of a gear spacer and cover for the gear drive shown in FIG. 10.

Each opening 29, 31 in the movable member 15 has preferably a curved lip 32, 34, shown best in FIG. 9 over which of the cord loop 10 travels. Pulling downward on either side of the cord 10 applies a downward force on one of the curved lips 32, 34. The downward force causes the movable member 15 to rotate. Even a slight rotation of a few degrees is all that is required to expand the spring 23 and release the hub 17 to permit the spool 19 to rotate freely. Since both ends of the cord loop 10 exit the spool 19 on the front side of the headrail 3, the movable member 15 is rotated counter clockwise regardless of which direction the spool 19 is rotated. When the cord 10 is released the spring 23 returns to its undeflected state and regains its light grip on the hub 17. The weight of the shade will turn the hub 17 in a clockwise direction which will cause the spring to grip progressively tighter to lock the shade in whatever position it is in when the cord 10 is released. Additionally, an end cap 45 may be provided to enclose the hub 15, spool 19, and movable member 15 within the recess 14 in the fixed housing 13. The assembly is placed within and attached to a headrail or for a roller shade hung on a mounting brackets as shown in FIG. 1. An alignment cover 59 shown in FIG. 11 fits over the opposite end of the assembly as shown in FIG. 7 and serves to align and contain the gears and the slip clutch.

The presently preferred embodiment of my release brake operator 1 employs a hub 17 which is offset from the take-up shaft 5 as can be seen in FIG. 7. The offset is accomplished using gears 47 and 49 in the arrangements shown in FIG. 10. Openings 56, 58 in the back face of the cover 59 provide proper spacing and alignment of first gear 47 and offset gear 49. The opening 56, 58 additionally provide bearing surfaces support the end 48 of the first gear 47 and the shaft 5 or slip clutch 53, whichever is attached to the offset gear 49. The gear system offsets hub 17 towards the front of the headrail 3. This feature is advantageous because it reduces the path of the looped cord 10 within the headrail 3. Consequently, the cord 10 is nearer to the edge of the headrail 3 and thus is not dragged along the bottom of the headrail 3 as far as it would if shaft 5 was along a centerline through the headrail as occurs in nearly all blinds. This both lowers the friction, which makes it easier to rotate the spool 19, and increases the life span of the cord 10 since it will not wear as quickly. Of course, one could connect shaft 5 directly or through a slip clutch to the hub 17. This gear system could be used in a motorized shade wherein a motor and gear box would be substituted for the clutch.

Figure 10:
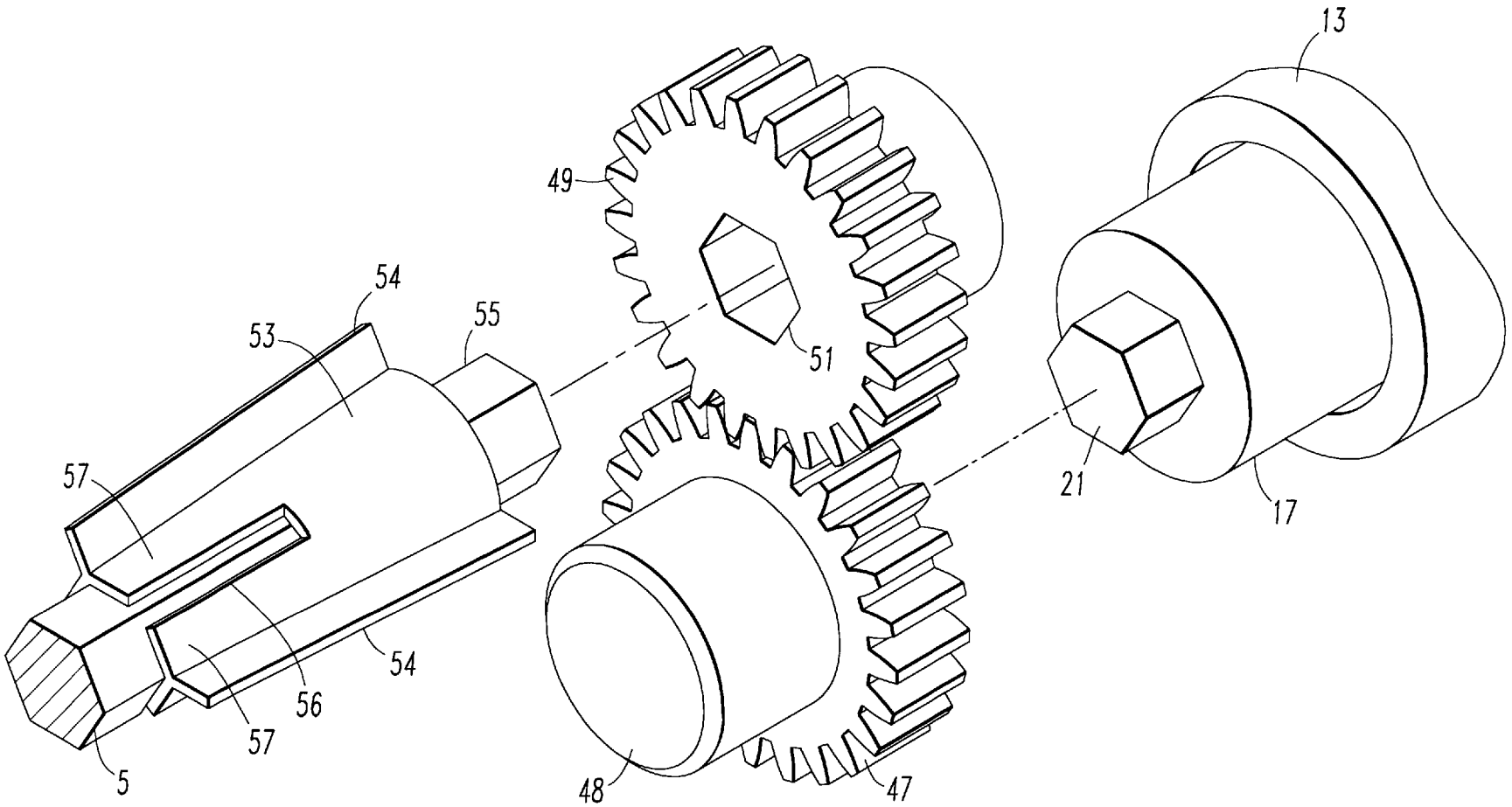
FIG. 10 is a perspective view partially in section of a present preferred offset gear drive for the present preferred release brake shade operator.

My present preferred offset gear drive mechanism is illustrated in FIG. 10. A first gear 47 is connected to the square or hex projection 21 on the end of the hub 17 which projects through the fixed housing 13. Then, a square or hex bore 51 in the mating face of the first gear 47 is provided to connect it to the hub 17. Next, an offset gear 49 is positioned in meshed engagement with the first gear 47. Besides the advantage of having the spool 19 offset to the front of the headrail, the gears 47, 49 can be interchanged. Consequently, the drive mechanism is interchangeable between a 1.7:1 ratio and a 3:1 ratio by merely switching the two gears 47, 49. The 1.7:1 and 3:1 ratios are obtained using the presently preferred gear sizes. These ratios were selected because many in the industry use a 1.7:1 gear ratio for smaller, lighter shades and a 3:1 ratio for wider, heavier shades. Consequently, this operator can be used for either type by simply switching gears. If desired, different ratios can be obtained using a different combination of gear sizes.

The face of the offset gear 49 is also provided with a square or hex bore 51 which mates with the square or hex shaped shaft 5. Most lift cord shafts used in the industry are metal and hex shaped. However, a square bore provides a better coupling for plastic parts. I prefer to provide a slip clutch 53 interposed between the offset gear 49 and the shaft 5. The slip clutch 53, as shown in FIG. 10, has a square or hex shaped end 55 which is sized to mate with a correspondingly square or hex shaped bore 51 in the offset gear 49. The opposite end of the slip clutch 53 has two or more prongs 57 separated by a slot 56 on either side. The prongs 57 define a square or hex shaped bore for receiving the shaft 5. The prongs 57 are sufficiently flexible such that if torque is applied to the shaft 5 by the hub 17 and the shaft 5 resists turning, the shaft 5 can slip within the prongs 57. The resistance of the slip clutch can be controlled by changing the length and width of slot 56 and by changing the dimensions of the ridges 54. This feature is advantageous as a safety mechanism to prevent breaking the lift cords 8, the gears or the loop. When the blind is raised completely up and the lift cords 8 are fully wound on the take up spools 6, the lift cords 8 may be broken if the spool 19 continues to be rotated causing the shaft 5 to rotate. If enough torque were applied to the shaft 5, the cord loop, spool teeth, gear teeth or lift cords 8 could break. However, with the slip clutch 53 in place, if torque is applied after the lift cords 8 are fully wound, the shaft 5 can slip within the prongs 57 of the slip clutch 53 to prevent breaking the lift cords 8. Another situation where the slip clutch is desirable is where the shade is somehow caught while being drawn up. If the spool 19 continued to be rotated the shaft 5 would slip and the lift cords 8 would not be in danger of breaking. The clutch 53 should slip prior to the breaking point of the lift cords, cord loop, spool teeth or gear teeth. Since the industry is moving toward smaller diameter lift cords, the slip clutch is an important feature in many window blinds.

Figure 12:
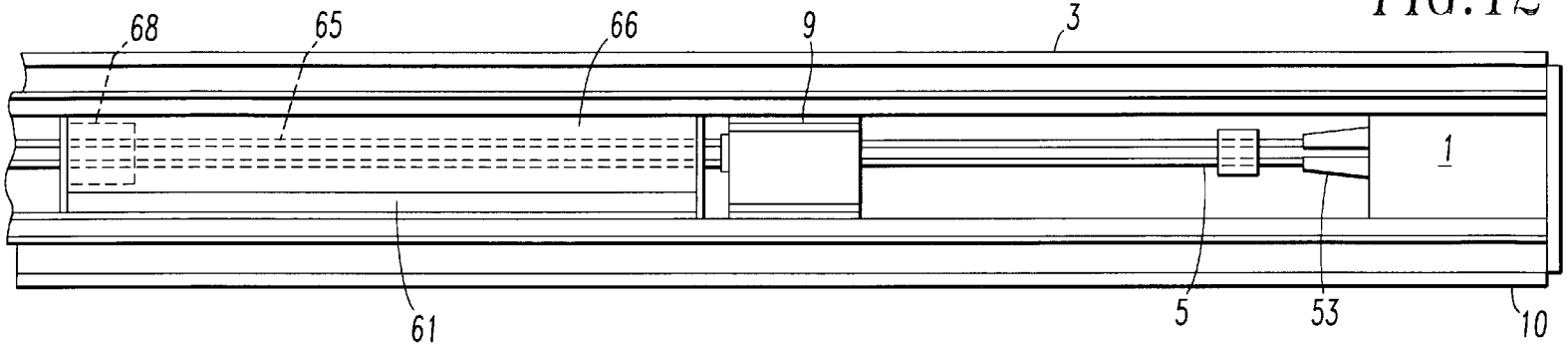
FIG. 12 is a top plan view of a right portion of a headrail containing my shade operator and a present preferred travel limiting mechanism.
Figure 13:
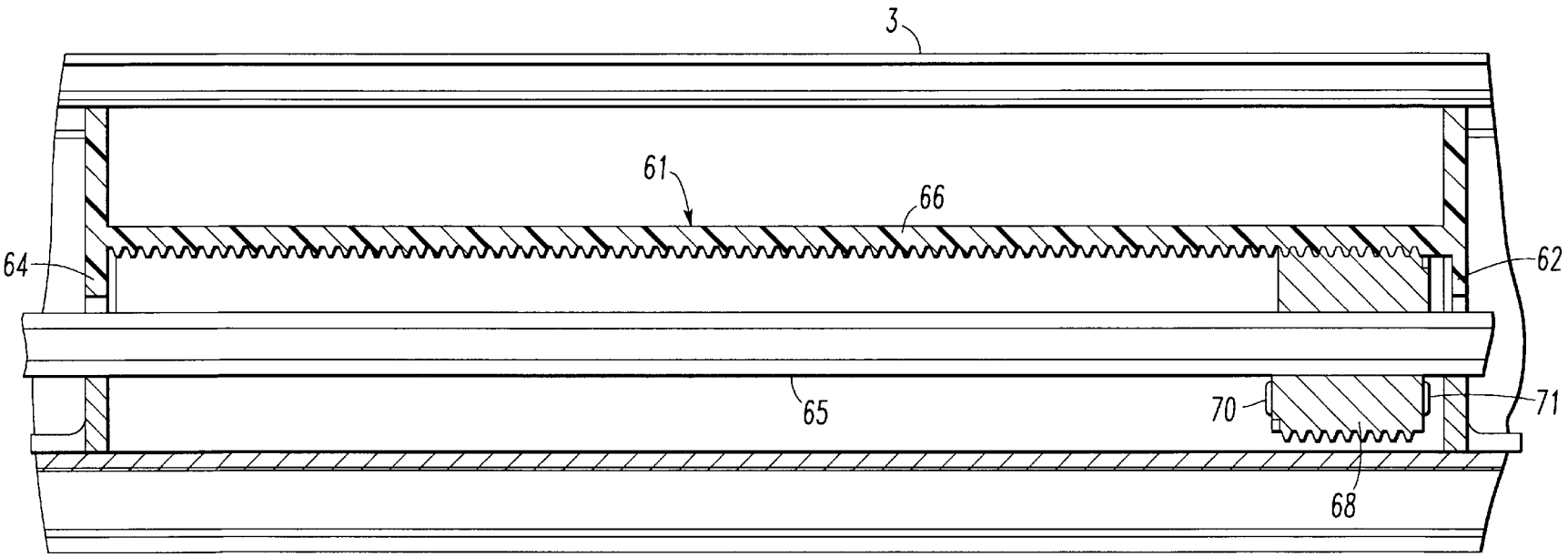
FIG. 13 is a side view partially in section of the travel limiting mechanism shown in FIG. 12.

I prefer to provide a travel limiting mechanism for my release brake shade operator 1 is shown in FIGS. 12 and 13. The travel limiting rack described is an additional mechanism provided to prevent over winding of the lift cords 8 on the take up rollers or spools 9. The travel limiting mechanism is preferably a fixed housing or rack 61 which is attached to the headrail 3. The rack 61 is provided with stops 62, 64. A shaft 5 extends from the slip clutch 53 of the shade operator 1 through the headrail 3. Lift cord spools 9 are attached to the shaft 5. A nut 68 rides freely on the shaft which typically has a hexagonal cross section. I prefer to provide external threads on the nut which engage a threaded member 66 of the rack. As the shaft 5 rotates the nut 68 moves along the shaft 5 until the nut hits stop 62 or stop 64. The stops 62, 64 limit the travel of the nut 68 and thus prevent further rotation of the shaft 5. Tabs 70 and 71 are provided on the opposite faces of the nut 68 to engage a landing on the stops 62 or 64. Alternatively, the nut 68 can be affixed to the shaft and the entire rack 61 can move along the threaded portion 65 of the shaft 5 as it is rotated. Travel of the rack 61 within the headrail 3 can be limited by stops provided at certain positions in the headrail 3. Those stops could be cradles which hold shaft 5 and spool assembly 9. Both the nut and the rack slide freely on the shaft and in the headrail respectively. The travel of the rack is limited by stops such as cradles. The nut is limited by the rack and the rotation of the shaft is limited by the nut and finally the length of the shade is limited by the shaft.

While specific embodiments of my invention have been described in detail, it will be appreciated by those skilled in the art that various modifications to those details could be developed in light of the overall teachings of the disclosure. Accordingly, the particular embodiments disclosed herein are intended to be illustrative only and not limiting to the scope of my invention which should be awarded the full breadth of the following claims and all embodiments thereof.

I claim:

1. A release brake shade operator for a window covering of the type having at least one roller about which one of a window covering material and lift cords are wound comprising:

a. a stationary member having a bore passing through the stationary member;

b. a movable member which is movable relative to the stationary member when not restrained, the movable member having a bore passing through the movable member which bore is aligned with the bore passing through the stationary member;

c. a hub rotatably disposed through the bore in the movable member and the bore in the stationary member, the hub having one end adapted to be connected to the roller and having an outside surface; and d. a spring having a selected diameter, a first tang at one end and a second tang at an opposite end, the first tang attached to the stationary member and the second tang attached to the movable member, the spring sized to press against the outside surface of the hub when in a relaxed condition, such that movement of the movable member will move one tang of the spring relative to the other tang to increase the diameter of the spring so that the spring does not restrain movement of the hub.

2. The release brake shade operator of claim 1 also comprising a spool attached to the hub.

3. The release brake shade operator of claim 1 further comprising a first gear connected to the first end of the hub and an offset gear in meshed engagement with the first gear.

4. The release brake shade operator of claim 3 wherein the first end of the hub and the roller have a like cross section and the first gear and the offset gear each have a bore defining a cross section corresponding to said like cross section to receive therein one of said first end of the hub and said roller such that the first gear and the offset gear are interchangeable.

5. The release brake shade operator of claim 3 further comprising a slip clutch interposed between the offset gear and the roller.

6. The release brake shade operator of claim 5 wherein the slip clutch comprises:

a. a first end connected to the offset gear; and b. a second end connected to the roller, the second end having a plurality of prongs which have inside surfaces defining a bore having a certain cross section, the roller having a cross section corresponding to said certain cross section, the plurality of prongs being resiliently flexible such that a predetermined amount of torque will cause the prongs to deflect outwards allowing the roller to rotate within the bore, and the prongs then returning to an undeflected state about when the torque is less than the predetermined amount.

7. The release brake shade operator of claim 6 wherein the first end of the slip clutch and the roller have a like cross section and the first gear and the offset gear each have a bore defining a cross section corresponding to said like cross section to receive therein one of said first end of the slip clutch and the roller.

8. The release brake shade operator of claim 1 also containing a cord connected to the spool.

9. The release brake shade operator of claim 8 wherein the cord is a looped cord.

10. The release brake shade operator of claim 8 wherein the cord is attached to the spool in a manner to be wound and unwound around the spool.

11. An improved roller shade of the type having a roller about which window covering material is rolled and unrolled wherein the improvement comprises a release brake shade operator comprised of:

a. a stationary member having a bore passing through the stationary member;

b. a movable member which is movable relative to the stationary member when not restrained, the movable member having a bore passing through the movable member which bore is aligned with the bore passing through the stationary member;

c. a hub rotatably disposed through the bore in the movable member and the bore in the stationary member, the hub having one end connected to the roller and having an outside surface; and d. a spring having a selected diameter, a first tang at one end and a second tang at an opposite end, the first tang attached to the stationary member and the second tang attached to the movable member the spring sized to press against the outside surface of the hub when in a relaxed condition, such that the movement of the movable member will move one tang of the spring relative to the other tang to increase the diameter of the spring so that the spring does not restrain movement of the hub.

12. The improved roller shade of claim 11 also comprising a counterbalance spring attached to the roller.

13. The improved roller shade of claim 11 further comprising a first gear connected to the first end of the hub and an offset gear in meshed engagement with the first gear and connected to the roller.

14. The improved roller shade of claim 13 wherein the first end of the hub and the roller have a like cross section and the first gear and the offset gear each have a bore defining a cross section corresponding to said like cross section to receive therein one of said first end of the hub and said roller such that the first gear and the offset gear are interchangeable.

15. The improved roller shade of claim 13 further comprising a slip clutch interposed between the offset gear and the roller.

16. The improved roller shade of claim 15 wherein the slip clutch comprises:

a. a first end connected to the offset gear; and b. a second end connected to the roller, the second end having a plurality of prongs which have inside surfaces defining a bore having a certain cross section, the roller having a cross section corresponding to said certain cross section, the plurality of prongs being resiliently flexible such that a predetermined amount of torque will cause the prongs to deflect outwards allowing the roller to rotate within the bore, and the prongs then returning to an undeflected state about the roller when the torque is less than the predetermined amount.

17. The improved roller shade of claim 16 wherein the first end of the slip clutch and the roller have a like cross section and the first gear and the offset gear each have a bore defining a cross section corresponding to said like cross section to receive therein one of said first end of the slip clutch and the roller such that the first gear and the offset gear are interchangeably connectable to the first end of the slip clutch.

18. The improved roller shade of claim 11 also comprising a spool attached to a hub and a cord connected to the spool.

19. The improved roller shade of claim 18 wherein the cord is a looped cord.

20. The improved roller shade of claim 18 wherein the cord is attached to the spool in a manner to be wound and unwound around the spool.

21. An improved blind of the type having a roller about which lift cords are rolled and unrolled wherein the improvement comprises a release brake shade operator comprised of:

a. a stationary member having a bore passing through the stationary member;

b. a movable member which is movable relative to the stationary member when not restrained, the movable member having a bore passing through the movable member which bore is aligned with the bore passing through the stationary member;

c. a hub rotatably disposed through the bore in the movable member and the bore in the stationary member, the hub having one end connected to the roller and having an outside surface; and d. a spring having a selected diameter, a first tang at one end and a second tang at an opposite end, the first tang attached to the stationary member and the second tang attached to the movable member the spring sized to press against the outside surface of the hub when in a relaxed condition, such that movement of the movable member will move one tang of the spring relative to the other tang to increase the diameter of the spring so that the spring does not restrain movement of the hub.

22. The improved blind of claim 21 further comprising a first gear connected to the first end of the hub and an offset gear in meshed engagement with the first gear and connected to the roller.

23. The improved blind of claim 22 wherein the first end of the hub and the roller have a like cross section and the first gear and the offset gear each have a bore defining a cross section corresponding to said like cross section to receive therein one of said first end of the hub and said roller such that the first gear and the offset gear are interchangeable.

24. The improved blind of claim 22 further comprising a slip clutch interposed between the offset gear and the roller.

25. The improved blind of claim 24 wherein the slip clutch comprises:

a. a first end connected to the offset gear; and b. a second end connected to the roller, the second end having a plurality of prongs which have inside surfaces defining a bore having a certain cross section, the roller having a cross section corresponding to said certain cross section, the plurality of prongs being resiliently flexible such that a predetermined amount of torque will cause the prongs to deflect outwards allowing the roller to rotate within the bore, and the prongs then returning to an undeflected state about the roller when the torque is less than the predetermined amount.

26. The improved blind of claim 25 wherein the first end of the slip clutch and the roller have a like cross section and the first gear and the offset gear each have a bore defining a cross section corresponding to said like cross section to receive therein one of said first end of the slip clutch and the roller such that the first gear and the offset gear are interchangeably connectable to the first end of the slip clutch.

27. The improved blind of claim 21 wherein the roller is enclosed within a headrail and further comprising a rotation limiting mechanism connected to the roller which prevents the roller from rotating when the blind is in one of a fully raised position and a fully lowered position.

28. The improved blind of claim 27 wherein the rotation limiting mechanism comprises:

a. a thread portion on the roller;

b. a rack disposed within and attached to the headrail, having spaced apart stops the threaded portion; and c. a nut having internal threads engaging the threaded portion of the roller and positioned for movement between the stops, the stops limiting the travel of the nut along the roller to stop the rotation of the roller.

29. The improved blind of claim 28 also comprising:

a. an externally threaded member connected to the rack; and b. external threads on the nut which engage the externally threaded member such that as the roller rotates the external threads of the nut engage the threaded member causing the nut to move along the roller.

30. The improved blind of claim 21 also comprising a spool attached to the hub and a cord connected to the spool.

31. The improved blind of claim 30 wherein the cord is a looped cord.

32. The improved blind of claim 30 wherein the cord is attached to the spool in a manner to be wound and unwound around the spool.

33. A release brake shade operator for a window covering of the type having a roller about which one of a window covering material and lift cords are wound comprised of:

a. a stationary member having a first cylindrical recess, a first cylindrical bore therethrough and a notch extending from the recess;

b. a cylindrical movable member rotatably disposed in said first recess, the movable member having a second cylindrical recess, a second cylindrical bore therethrough and a face having a notch;

c. a cylindrical hub rotatably disposed in the first and second bores through the stationary member and the movable member, the hub having a first end adapted to be connected to the roller, and an outside surface;

d. a spring disposed about the outside surface of the hub, the spring having a selected diameter, a first tang at one end and a second tang at an opposite end, the first tang retained in the notch in the stationary member and the second tang retained in the notch in the movable member, the spring sized to press against the outside surface of the hub when in a relaxed condition to restrain rotation of the hub, and the tangs of the spring movable relative to each other to increase the diameter of the spring so that the spring does not restrain movement of the hub; and e. a cylindrical spool attached to a second end of the hub and rotatably disposed in said second cylindrical recess in the movable member.

34. The release brake shade operator of claim 33 further comprising a first gear connected to the first end of the hub and an offset gear in meshed engagement with the first gear and connected to the roller.

35. The release brake shade operator of claim 34 wherein the first end of the hub and the roller have a like cross section and the first gear and the offset gear each have a bore defining a cross section corresponding to said like cross section to receive therein one of said first end of the hub and said roller such that the first gear and the offset gear are interchangeable.

36. The release brake shade operator of claim 34 further comprising a slip clutch interposed between the offset gear and the roller.

37. The release brake shade operator of claim 36 wherein the slip clutch comprises:

a. a first end connected to the offset gear; and b. a second end connected to the roller, the second end having a plurality of prongs which have inside surfaces defining a bore having a certain cross section, the roller having a cross section corresponding to said certain cross section, the plurality of prongs being resiliently flexible such that a predetermined amount of torque will cause the prongs to deflect outwards allowing the roller to rotate within the bore, and the prongs then returning to an undeflected state when the torque is less than the predetermined amount.

38. The release brake shade operator of claim 37 wherein the first end of the slip clutch and the roller have a like cross section and the first gear and the offset gear each have a bore defining a cross section corresponding to said like cross section to receive therein one of said first end of the slip clutch and the roller.

39. The release brake shade operator of claim 33 also containing a cord connected to the spool.

40. The release brake shade operator of claim 39 wherein the cord is a looped cord.

41. The release brake shade operator of claim 39 wherein the cord is attached to the spool in a manner to be wound and unwound around the spool.

42. A release brake shade operator for a window covering of the type having at least one roller about which one of a window covering material and lift cords are wound comprising:

a. a stationary member having a bore passing through the stationary member;

b. a movable member which is movable relative to the stationary member when not restrained, the movable member having a bore passing through the movable member which bore is aligned with the bore passing through the stationary member;

c. a hub rotatably disposed through the bore in the movable member and the bore in the stationary member, the hub having one end adapted to be connected to the roller and having an outside surface; and d. a spring having a first tang at one end and a second tang at an opposite end, the first tang attached to the stationary member and the second tang attached to the movable member, such that movement of the movable member in a first direction will move said second tang of the spring relative to said first tang to decrease the diameter of the springs so that the spring retrains movement of the hub, and such that movement of the movable member in a second direction will move said tang of the spring relative to the first tang to increase the diameter of the spring so that the spring does not restrain movement of the hub.

43. The release brake shade operator of claim 42 wherein said stationary member and said movable member having bearing surfaces adapted to contact each other and wherein the second tang is attached to the movable member by means of said contact.

44. The release brake operator of claim 43 wherein the bearing surface of said movable member has a notch adapted to receive said second tang.

* * * * *